US005938430A

United States Patent [19]

Majerowski

[11] Patent Number: 5,938,430

[45] Date of Patent: Aug. 17, 1999

[54] LIQUID FUEL LAMP

[75] Inventor: Amelia H. Majerowski, Kenosha, Wis.

[73] Assignee: S.C. Johnson & Son, Inc., Racine, Wis.

[21] Appl. No.: 09/080,937

[22] Filed: May 19, 1998

[51] Int. Cl.[6] ..... F23Q 25/00

[52] U.S. Cl. ..... 431/320; 431/343; 431/345

[58] Field of Search ..... 431/146, 148, 431/125, 320, 322, 324, 344, 345, 310, 343; 362/161, 159, 415, 810

[56] References Cited

U.S. PATENT DOCUMENTS

| | | | |
|---|---|---|---|
| 373,958 | 11/1887 | Barth . | |
| 444,767 | 1/1891 | Prier . | |
| 2,512,885 | 6/1950 | Archambeau | 67/55 |
| 3,097,514 | 7/1963 | Stone | 431/324 |
| 3,236,072 | 2/1966 | Goldszmid | 431/125 |
| 3,994,762 | 11/1976 | Novak | 431/324 |
| 4,728,286 | 3/1988 | Olsen | 431/320 |
| 4,781,577 | 11/1988 | Stuart | 431/320 |
| 5,000,678 | 3/1991 | Thompson | 431/320 |
| 5,127,825 | 7/1992 | Tendick, Sr. | 431/320 |
| 5,395,234 | 3/1995 | Guiterrez | 431/315 |
| 5,807,093 | 9/1998 | Tendick, Sr. | 431/320 |

FOREIGN PATENT DOCUMENTS 22196 of 1882 United Kingdom .

OTHER PUBLICATIONS

Instruction page, undated, Lamplight Farms, admitted prior art. (No Date).

Photos of Lamplight Farms lamp, addmitted prior art, date unknown.

Second Lamplight Farms, Inc. oil lamp, date uncertain, acknowledged as prior art.

*Primary Examiner*—Carl D. Price

[57] ABSTRACT

A liquid fuel lamp having a fuel container for containing a combustible liquid fuel, the fuel container having an open mouth. A non-metallic flame guard is connected to the fuel container and closes the mouth, the flame guard having a flared skirt that extends radially outward, covering the fuel container, and a wick opening in the flame guard, located above the mouth of the fuel container. A flame resistant wick holder is located in the wick opening and is not in contact with the fuel container. A wick extends upwardly from within the fuel container, through the wick holder, to a location above the flame guard without any continuous metallic heat flow path from the wick holder to the fuel container. The portion of the wick beneath the flame guard is guarded from free contact with the atmosphere surrounding the lamp by the combined action of the fuel container, flame guard, and wick holder.

13 Claims, 2 Drawing Sheets

26
27
24
30
20
14
32
25
36
12
19
34
18

LIQUID FUEL LAMP

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to liquid fuel lamps, including lamps suitable for use in outdoor garden torches.

Liquid fuel torches or lights are available in the form of pseudo candles that are designed primarily for outside use. One such liquid fuel light is described in U.S. Pat. No. 2,512,885.

There are also a variety of known garden torches that are designed to be employed out-of-doors in hotel gardens, residential patios, or the like. These torches typically have a fuel container in which is placed a wick. The wick extends upwardly through and is held by a flame guard. The flame guard extends over and protects the fuel container from the flame. Typically a threaded cap is attached to the under side of the flame guard, the cap receiving and closing the fuel container and securing it to the flame guard. These torches also often employ a basket made of bamboo or other materials. The basket is of a size and shape such as to conveniently hold the fuel container in a generally upright position, and the basket itself is often held aloft by a ground-engaging pole. Often the flame guard extends laterally sufficiently to cover the upper rim of the basket, providing both a decorative effect and protecting the basket from the flame.

There are various problems with many of the flame guard and cap systems used to separate the flame from the fuel container and to close the fuel container. The flame guard itself directly contacts the wick at the point where it is burning and therefore is typically made of metal so as to withstand flame temperatures. The common use of inexpensive, ferrous metals in flame guards leads to potential rusting problems. But, even more problematic, metal conducts heat. Typically, the fuel container of liquid fuel torches can become distinctly warm and must be vented to relieve internal pressure caused by heat transferred via the flame guard from the torch's flame to the fuel container. Such heat also makes the use of a plastic fuel container difficult, as opposed to traditional metal containers, because of the danger of melting or deforming a plastic container.

A garden torch sold by Lamplight Farms, Inc. of Menomonee Falls, Wis., appears to be designed to address the issue of heat transfer to the fuel container. Apparently at least in part to reduce such heat transfer, the wick of the Lamplight Farms torch is held by a vertically oriented, metal sleeve that forms a part of a metal flame guard. The metal sleeve extends through the flame guard and ends at a point under the flame guard. Then, after an air gap, a metal screw cap is located beneath the metal sleeve. The screw cap has a central hole that has the same diameter as and is held in line with the metal sleeve. The fuel container screws into the screw cap. The wick extends downwardly through the metal sleeve and then on downwardly, through the hole in the screw cap and into the fuel container. Four, spaced braces fasten the screw cap to the underside of the flame guard, the braces attaching to the flame guard at a point remote from the flame.

As a consequence of this structure, the metal heat-flow path from the flame's location to the fuel container is made considerably longer and more circuitous than would be the case if the metal sleeve attached directly to the cap or if the cap were fastened directly to the flame guard, without the use of the intervening braces. Furthermore, the braces have relatively small cross sections, further reducing heat flow toward the fuel container. However, the resulting structure is complex and involves a number of parts that must be formed separately and then assembled, leading to manufacturing expense.

Presenting a further disadvantage, in the Lamplight Farms torch, the part of the wick that spans the air gap between the metal sleeve and the screw cap is openly exposed to the surrounding atmosphere. This exposure is in a space located directly under the metal flame guard, and, as a consequence, the air in that space predictably warms as the torch burns. Because that space is open to the atmosphere, it requires no separate venting to avoid pressure build-up. However, this arrangement leaves exposed to warmed air a portion of wick that is wet with fuel and provides no structure capable of blocking air circulation around the wet wick from even a slight breeze or other air flow. The fuel thus warmed may be expected to evaporate from the exposed wick and escape unburned into the atmosphere, causing waste and increased raw fuel odors. Because the amount of fuel evaporated could be expected to vary with the amount of breeze blowing on the lamp, a further result would be inconsistent overall fuel consumption rates.

The Lamplight Farms torch just described is sold equipped with a plastic fuel container. Even though fuel container venting would appear still to be necessary, the structures just described for reducing heat flow apparently are sufficiently successful that the fuel container can be made of a meltable plastic rather than metal. However, as mentioned above, the torch is deficient in that it requires manufacture by assembly of complicated, multi-component substructures, leading to a cost of manufacture higher than that which would be required for a simpler structure, and in that it allows raw fuel to evaporate from an exposed portion of fuel-wet wick.

Typical prior art torches, including the Lamplight Farms torch, use fuel containers that have narrow, restricted necks. This feature makes it undesirably difficult for a manufacturer to insert the wick into the fuel container in an automated assembly process and also makes it difficult for a user to attach a fuel container to the cap held by a flame guard, whether refilling or replacing an exhausted fuel container. It may even be necessary for a user to guide the fuel-wetted wick by hand into the neck of such a fuel container, which may be messy and distasteful. The need to insert a wick through first the metal tube and then the hole in the screw cap makes the Lamplight Farms torch especially difficult to manufacture.

It can therefore be seen that there is a need for improved liquid fuel lamps, including such lamps suitable for use in garden torches.

BRIEF SUMMARY OF THE INVENTION

The invention provides a liquid fuel lamp that has a fuel container for containing a combustible liquid fuel. The fuel container has an open mouth. A non-metallic flame guard is connected to the fuel container and closes the mouth. The flame guard has a laterally flared skirt that extends radially outward, preferably covering the fuel container and even extending beyond the fuel container for a selected distance.

A wick opening extends downwardly through the flame guard, and is located above the mouth of the fuel container.

A flame resistant wick holder is located and preferably is a separate structure that is retained in the wick opening and is so placed as not to be in contact with the fuel container. A wick holder shall be understood as "flame resistant" if it can withstand the heat from a lighted wick without functional degradation. If the flame guard is itself made of flame resistant materials, such as a ceramic material, the wick holder may simply be the interior surface of the wick opening. A wick extends upwardly from within the fuel container, through the wick holder, to a location above the flame guard without any continuous metallic heat flow path existing between the wick holder and the fuel container.

In the preferred embodiment, the wick holder is a metal tube that extends through the flame guard in a generally up-and-down direction and is engaged in the wick opening. The metal tube may be made of steel, aluminum, or any convenient metal. Steel is preferred. Ceramic, heat-resistant glass or quartz, or other flame-resistant materials of kinds familiar to those skilled in the art could also be used.

Preferably, the combination of the fuel container, flame guard, and wick holder protects the part of the wick located beneath the flame guard from free contact with the atmosphere surrounding the lamp. The wick located under the flame guard is defined as being guarded from "free" contact with the atmosphere surrounding the lamp if any air flow route from that portion of the wick to the atmosphere surrounding the lamp is so restricted or convoluted that, while pressure differentials requiring venting can be relieved, the air in direct contact with the wick is substantially undisturbed by the breeze from a conventional eight inch (20 cm) table fan blowing on the lamp from the side when the flame guard and fuel container are tested separate from any lamp holder, chimney, or other additional protective structure. Air disturbance can be detected by such practical means as visual observance of smoke from burning punk or the like, with the lamp to be tested being entirely free of fuel.

It is preferred that the space above any fuel in the fuel container be vented to relieve pressure caused by warming as the lamp burns. Such venting may be accomplished while still protecting the wick from free contact with the atmosphere surrounding the lamp by providing either a small hole penetrating the flame guard, a space maintained between the wick and the wick holder, air passages incorporated into the connection between the fuel container and the flame guard, or any of various other venting strategies that will be apparent to one skilled in the art. The preferred mode of venting is the provision of air passages incorporated into the connection between the fuel container and the flame guard.

In a preferred embodiment, the flame guard and all parts unitarily formed with the flame guard are molded by conventional means out of plastic, preferably out of a plastic material having a heat resistance temperature of at least 170° C. A plastic is defined to have a given "heat resistance temperature" if the plastic retains 75% of its original flexural strength after seven days of exposure to the temperature. A thermoset plastic is preferred, and preferably a polyester or phenolic thermoset plastic. Such a material has an ability to conduct heat that is much less than that of common metals.

Those skilled in the art will be aware of other, non-metallic materials suitable for use to make the flame guard instead of such plastics, including ceramic, glass, pressed or molded non-combustible fiber, or even wooden materials, depending on the height above the flame guard at which the wick holder is caused to hold the wick. The preferred fuel container is made of metal, glass, or (most preferred) even an inexpensive plastic, which may even be a plastic that distorts or melts at a relatively low temperature. Polyvinyl chloride is preferred, which may be clear, providing the possibility of decorative effects if colored fuel is used, as well as an easy use-up cue.

In another preferred embodiment, the fuel container is removably connected to the flame guard. Preferably, an attachment collar is unitarily formed with the flame guard and extends downwardly from the underside of the flame guard, with the mouth of the fuel container being removably attached to either internal or external surfaces of the attachment collar. Special advantage is gained if the attachment collar is at least three time times as wide as the widest cross-sectional dimension of the wick. This arrangement facilitates automated insertion of a wick into the mouth of the fuel container during manufacture or manual wick insertion, when, for example, an exhausted fuel container is being replaced by a user. Furthermore, a wide attachment collar distances the mouth of the fuel container from the wick holder and therefore from the location of the flame when the wick is burning. This further decreases the temperature that the material of which the fuel container is made must be capable of resisting.

One skilled in the bottle and cap art will be well aware of a variety of ways for attaching the fuel container to the flame guard, including, strictly as non-limiting examples, screw, snap, and similar mechanical fittings. A bayonet attachment is preferred for its general convenience and for the limited amount of turning of the fuel container necessary with respect to the flame guard to accomplish attachment. It is preferred but not required that the wick, fuel container mouth, and attachment collar all be round.

A small gap at the mouth of the fuel container for venting may be provided by molding a spacer or lug into either the mouth of the fuel container or, as is preferred, into the attachment collar to prevent the mouth or neck of the fuel container from completely sealing against the flame guard. It is well within the ability of one skilled in the art to determine empirically the size of such a gap large enough to vent gas pressure but still small enough to prevent the free contact of that portion of wick which is located beneath the flame guard with the atmosphere surrounding the lamp. A circuitous air venting path may also be provided to further discourage free contact with the wick.

The invention also provides a garden torch that includes a lamp holder having a lamp well that is capable of receiving and holding the fuel container of the lamp of the invention. Preferably, the lamp well is defined by the inner surfaces of a decorative basket or similar holder. Preferably the garden torch also has a support pole that can be thrust into the ground or otherwise secured to support the lamp in a generally elevated, upright position for use. The upper margin of the lamp well forms a well rim, and preferably the flame guard of the lamp extends laterally beyond the well rim.

DETAILED DESCRIPTION OF THE INVENTION

Figure 1:
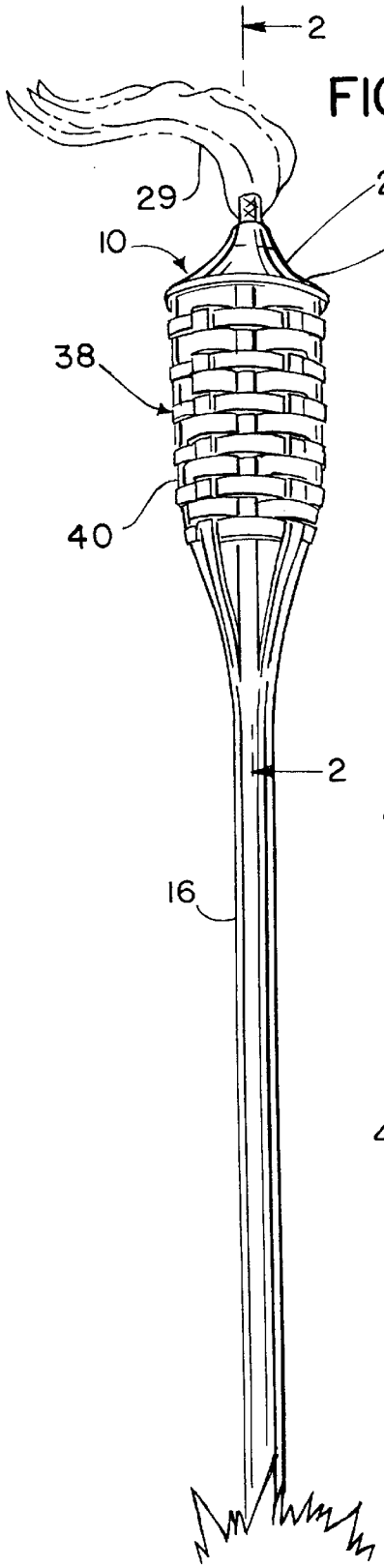
FIG. 1 is an elevational view of a garden torch containing the lamp of the invention.
Figure 2:
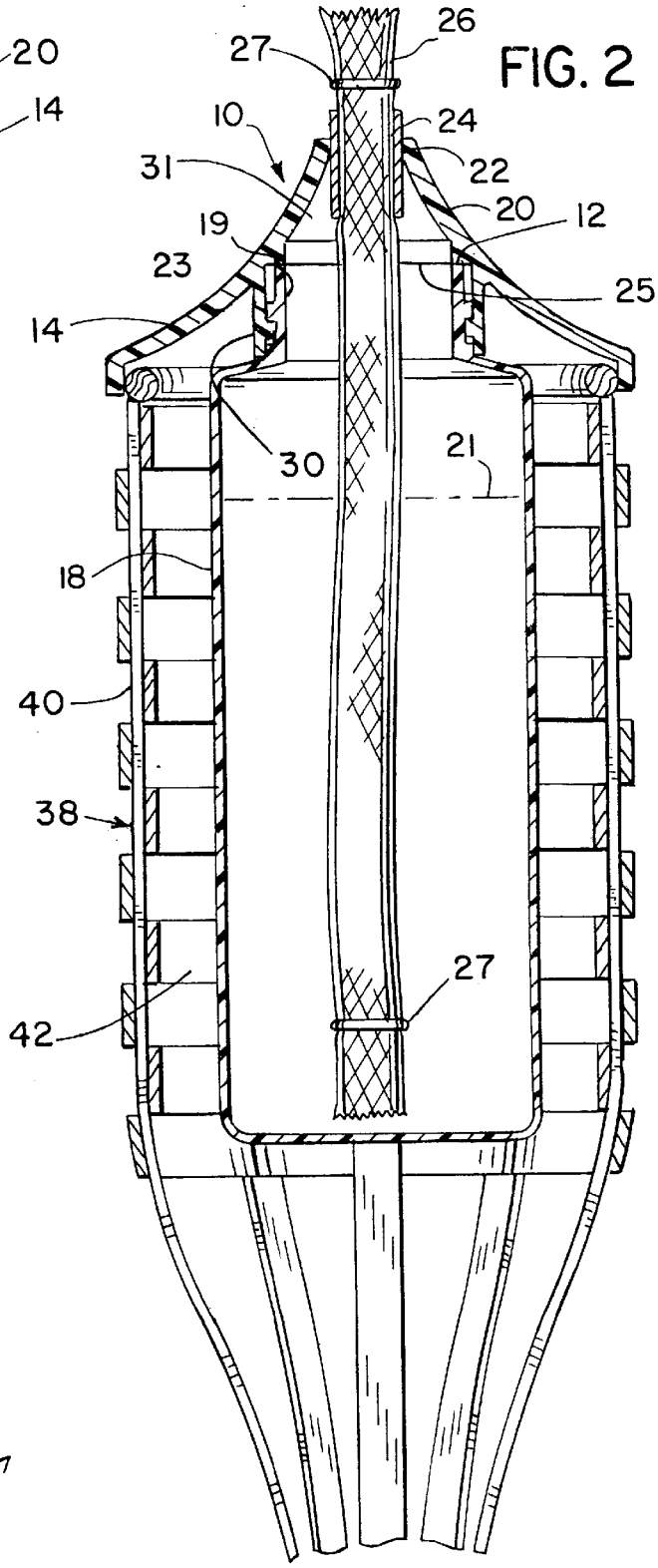
FIG. 2 is a partial enlarged vertical sectional view of the garden torch of FIG. 1, taken along section line 2—2 of FIG. 1.

Turning now to the drawings, wherein like reference numbers refer to like and corresponding parts throughout the several views, a liquid fuel lamp is shown generally at 10 in FIG. 1. In FIGS. 1 and 2, the lamp 10 is shown held by a lamp holder 38, which is described in more detail, below. The lamp 10 includes a fuel container 18 having an open mouth 12, both best seen in FIGS. 2 and 3. A flame guard 20 is connected to the fuel container 18 and closes the mouth 12 of the fuel container. The fuel container 18 is capable of holding liquid fuel, shown schematically at 21 of FIG. 2. The flame guard 20 has a flared skirt 14 that extends radially outward to cover the fuel container 18.

The flame guard 20 is made of a non-metallic material. In the preferred embodiment shown, the flame guard 20 is made of a heat resistant plastic, and most preferably of a polyester thermoset plastic, such as the polyester thermoset resin 01581 sold by Plastics Engineering Company of Sheboygan, Wis. Other plastics, such as the phenolic resin 02571, also sold by Plastics Engineering Company, are also suitable, although polyester thermoset resin 01581 is preferred as being less brittle than the phenolic resin. Other non-metallic materials, noted above, are also possible but, for various manufacturing, durability, or cost reasons, are less preferred. It is preferred that the flame guard 20 be made of a plastic material having a "heat resistance temperature" of at least 170° C., as that term is defined, above.

A wick opening 22, seen in FIG. 2, extends through the flame guard 20 at a point located above the mouth 12 of the fuel container 18 and spaced from the point of attachment of the mouth to the flame guard. A flame resistant wick holder 24 is retained in the wick opening 22 and is so located as to not contact the fuel container 18. "Flame resistant" has the meaning set forth above. In the preferred embodiment, the wick holder 24 is made of steel and is inserted into the flame guard 24 in conventional ways at the time the flame guard is molded. Steel is preferred as an inexpensive metal. But a variety of other possible materials has been discussed, above, and any flame resistant material of sufficient strength to withstand manufacturing and use handling is potentially suitable. It would even be possible, if the non-metallic material of the flame guard 20 is of an appropriate flame resistance, for the wick holder 24 to be unitarily formed as a part of the flame guard, avoiding the need for a separately manufactured wick holder. When so described, the "wick holder" would constitute, in essence, the interior surfaces of the wick opening 22.

A wick 26 extends upwardly from within the fuel container 18, through the wick holder 24, to a location above the flame guard 20. In use, fuel from the fuel container 18 travels by capillary action up the wick 26 to a location above the flame guard 20, where it may be burned. The preferred wick 26 is made of braided or bundled fiberglass. The wick shown at 26 has binding clips 27 at each end to prevent unraveling, although conventional wicks having minimal tendency to unravel and not requiring such clips are available and are preferred. It will be apparent from an examination of the drawings that there is no continuous metallic heat flow path from the location of a flame (shown at 29 in FIG. 1) to the fuel container 18.

In addition, in the preferred embodiment shown in the Figures, the mouth 12 of the fuel container 18 abuts against the underside of the flame guard 20, enclosing a space 23 (seen in FIG. 2) beneath the flame guard and the interior of the fuel container 18. Preferably, the fuel container 18 contacts the underside of the flame guard 20 with sufficient sealing effect that the fuel container, flame guard, and wick holder 24 protect the part of the wick 26 located beneath the flame guard from "free" contact with the atmosphere surrounding the lamp, as that term is defined, above. Preferably, in order to encourage a consistent seal, a seat 25 is molded in the underside of the flame guard 20 to present a suitable and preferably generally flat surface toward the mouth 12 of the fuel container 18.

Figure 3:
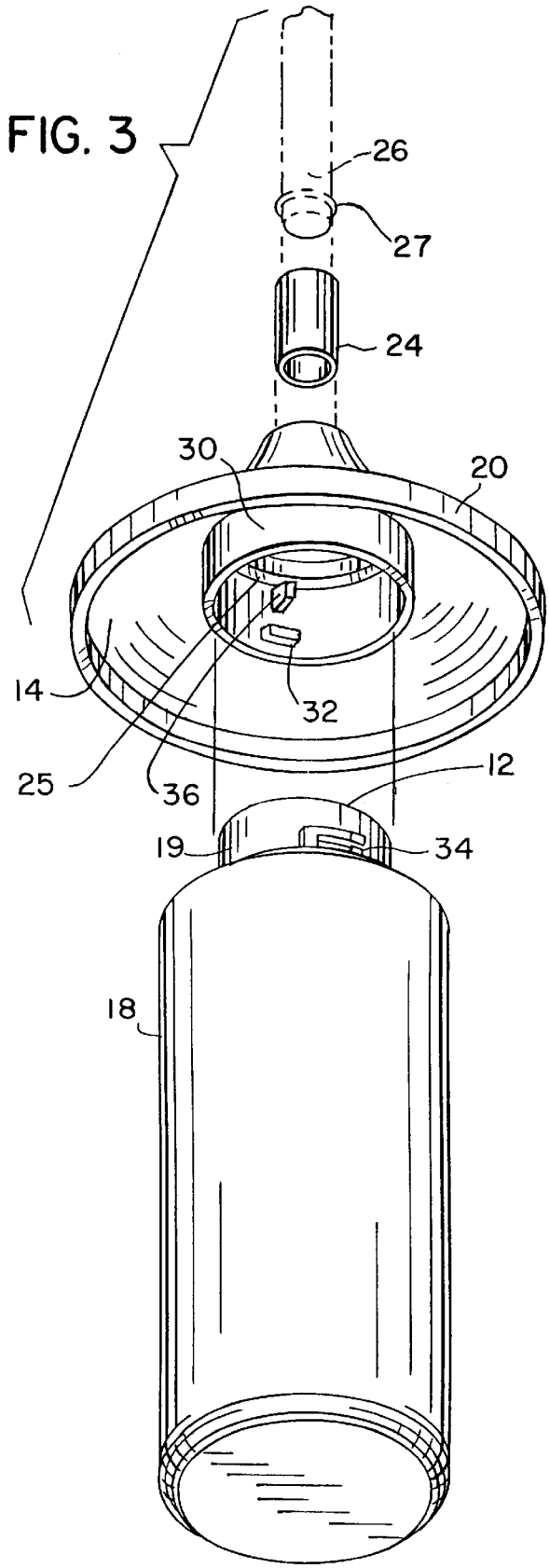
FIG. 3 is an exploded perspective view of the lamp shown in the garden torch of FIG. 1.

In the preferred embodiment of the lamp 10 shown in the Figures, the fuel container 18 is removably connected to the flame guard 20. In the embodiment shown, an attachment collar 30 is unitarily formed with the flame guard 20 and extends downwardly from the underside of the flame guard. Non-unitary construction is also possible, of course, but unitary construction is preferred for ease and economy of manufacture. The fuel container 18 includes a neck 19 whose upper surfaces define the mouth 12, the neck being attached to interior surfaces of the attachment collar 30 by a conventional bayonet attachment, such as that shown in the figures. The bayonet attachment shown has conventional bayonet lugs 32 on the attachment collar 30 and cooperating receiving ribs 34 on the neck 19 of the fuel container 18. Other attachment options are discussed, above, but the bayonet attachment shown is preferred for ease of manufacture and use. These features are best shown in FIG. 3.

In the preferred embodiment, the neck 19 of the fuel container 18 is somewhat smaller in diameter than the internal surfaces of the attachment collar 30. Centering ribs 36 project inwardly from the attachment collar 30 for a distance sufficient to secure the neck 19 at a centered position slightly spaced from the attachment collar 30. The seal of the mouth 12 of the fuel container 18 against the underside of the flame guard 20 is sufficiently incomplete that pressure generated within the fuel container can vent past that seal and travel a circuitous path down the side of the neck 19 to be released into the surrounding atmosphere. If necessary, a small notch (not shown) can be made in the fuel container mouth 12 to ensure sufficient venting. Such deliberate breaches of the seal between the mouth 12 and underside of the flame guard 20 can be adjusted to be of a size that allows venting but still protects the part of the wick 26 located beneath the flame guard from free contact with the atmosphere surrounding the lamp.

As is apparent in the figures, which show these features approximately to scale, the attachment collar 30 is at least three times as wide as the widest cross-sectional dimension of the wick 26. This facilitates automatic insertion of the wick into the fuel container during manufacture and also makes more convenient a user's replacement of an exhausted fuel container.

The garden torch of the invention, shown generally at 38 in FIGS. 1 and 2, includes a lamp holder 40 and, preferably, a support pole 16 capable of being thrust into the ground or otherwise engaged to hold the lamp holder in an elevated and generally upright position. The lamp holder 40 has interior surfaces defining a lamp well 42. A lamp 10, as described above, is positioned in the lamp well 42. Preferably, the lamp holder 40 is a basket.

The preceding description is merely of preferred embodiments of the invention. One skilled in the art will readily apprehend alternative embodiments that nevertheless fall within the scope and breadth of the invention. Thus, the claims should be looked to in order to understand the full scope of the invention.

INDUSTRIAL APPLICABILITY

Lamps and garden torches, as described, are of use for illumination and decoration. Insect repellent, such as citronella, may be included in their fuel. The flame guard 20 and fuel container 18 may be made by conventional plastic molding techniques, and the torch holder and remaining parts of the garden torch may be made by conventional manufacturing techniques well known to those skilled in the art.

I claim:

1. A liquid fuel lamp comprising:

a. a plastic fuel container for containing a combustible liquid fuel, the fuel container having an open mouth;

b. a non-metallic flame guard connected to the fuel container and closing the mouth, the flame guard having a flared skirt that extends radially outward to cover the fuel container;

c. a wick opening in the flame guard, located above the mouth of the fuel container;

d. a flame resistant metallic wick holder located in the wick opening and not in contact with the fuel container; and e. a wick extending upwardly from within the fuel container beneath the flame guard, through the wick holder, to a location above the flame guard without any continuous metallic heat flow path between the wick holder and the fuel container.

2. The lamp of claim 1, wherein the combination of the fuel container, flame guard, and wick holder protect that part of the wick which is located beneath the flame guard from free contact with the atmosphere surrounding the lamp.

3. The lamp of claim 1, wherein the flame guard is made of plastic.

4. The lamp of claim 1, wherein the flame guard is made of a plastic material having a heat resistance temperature of at least 170° C.

5. The lamp of claim 4, wherein the plastic material is a thermoset plastic.

6. The lamp of claim 1 wherein the flame guard is made of a flame resistant material and the interior surfaces of the wick opening are the flame resistant wick holder.

7. The lamp of claim 1, wherein the fuel container is removably connected to the flame guard.

8. The lamp of claim 7, wherein an attachment collar is unitarily formed with the flame guard and extends downwardly from the underside of the flame guard.

9. The lamp of claim 8, wherein a. the attachment collar is at least three-times as wide as the widest cross-sectional dimension of the wick, and b. the mouth of the fuel container is removably attached to the attachment collar.

10. The lamp of claim 8, wherein the fuel container is attached to the attachment collar by a bayonet attachment.

11. The lamp of claim 8, wherein the portion of the wick beneath the flame guard is guarded from free contact with the atmosphere surrounding the lamp by the combined action of the fuel container, flame guard, and wick holder.

12. A garden torch, comprising:

a. a lamp holder having a lamp well; and b. a lamp of claim 1 positioned in the lamp well.

13. The garden torch of claim 12, including a support pole attached to the lamp holder to hold it in an elevated position.

* * * * *